US005224403A

United States Patent [19]

Rueb

[11] Patent Number: 5,224,403

[45] Date of Patent: Jul. 6, 1993

[54] PREDETERMINED TORQUE YIELDING WRENCH

[76] Inventor: Ward A. Rueb, 1900 Bay Area Blvd., Q184, Houston, Tex. 77058

[21] Appl. No.: 864,408

[22] Filed: Apr. 6, 1992

[51] Int. Cl.[5] ..... B25B 23/159

[52] U.S. Cl. ..... 81/477; 81/478; 81/480

[58] Field of Search ..... 81/477, 478, 480, 481

[56] References Cited

U.S. PATENT DOCUMENTS

| | | | |
|---|---|---|---|
| 1,512,192 | 10/1924 | Benko | 81/472 |
| 2,332,972 | 10/1943 | Johnson | 81/480 |
| 2,427,153 | 9/1947 | Mossberg | 81/52.4 |
| 2,674,108 | 4/1954 | Latimer | 64/29 |
| 2,734,412 | 3/1956 | Orner | 81/52.4 |
| 3,003,378 | 10/1961 | Hotchner | 81/52.4 |
| 3,137,187 | 6/1964 | Van Hoose | 81/52.4 |
| 3,279,286 | 10/1966 | Larson | 81/52.4 |
| 3,847,038 | 11/1974 | Green | 81/477 |

FOREIGN PATENT DOCUMENTS

| | | | |
|---|---|---|---|
| 675755 | 5/1939 | Fed. Rep. of Germany | 81/477 |
| 1257722 | 2/1961 | France | 81/477 |
| 203555 | 8/1968 | U.S.S.R. | 81/480 |

*Primary Examiner*—James G. Smith

[57] ABSTRACT

A calibrated torquing wrench that can be set to a predetermined value and upon reaching this torque by the rotation of the wrench will release the gear (28), spring (34) engagement and will allow the wrench to freewheel for a small angle before re-engagement of the gear (28) and spring (34). The wrench will then endlessly rotate and repeat the predetermined value without exceeding the setting.

14 Claims, 4 Drawing Sheets

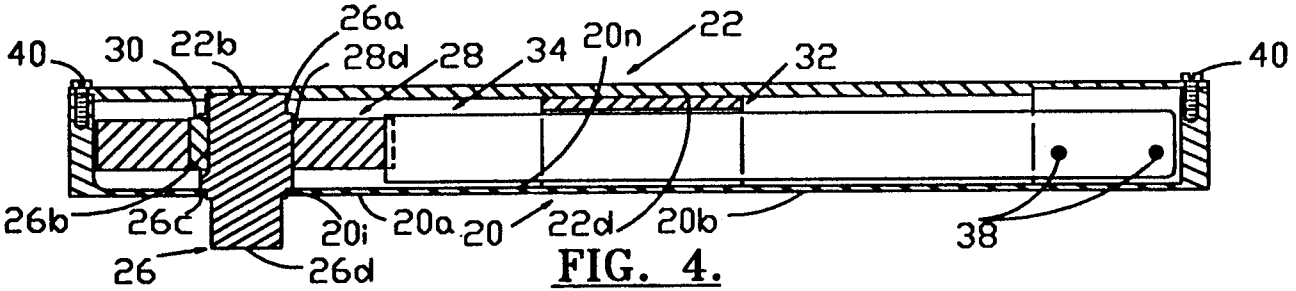
FIG. 4.
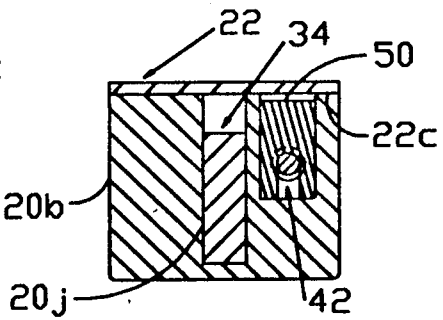
FIG. 9.
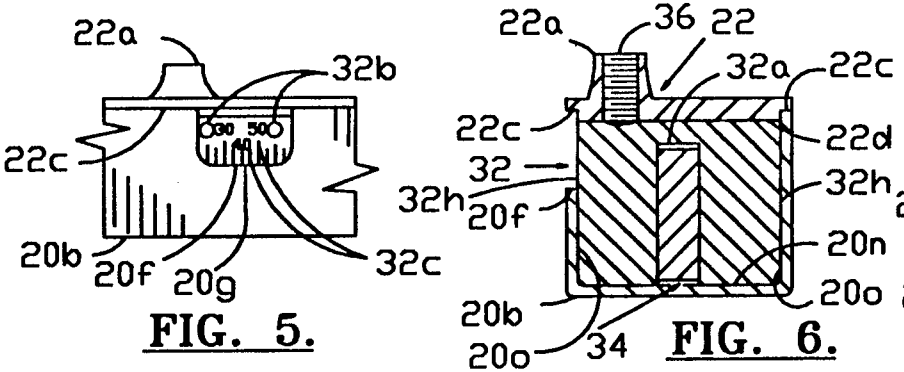
FIG. 6.
FIG. 5.
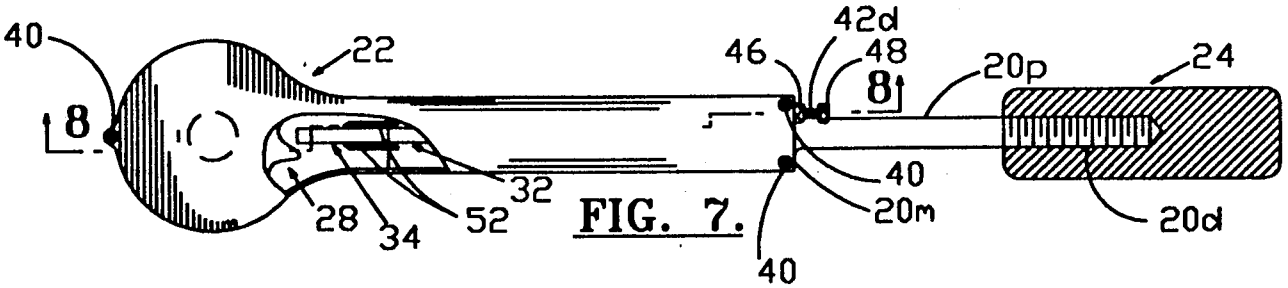
FIG. 7.

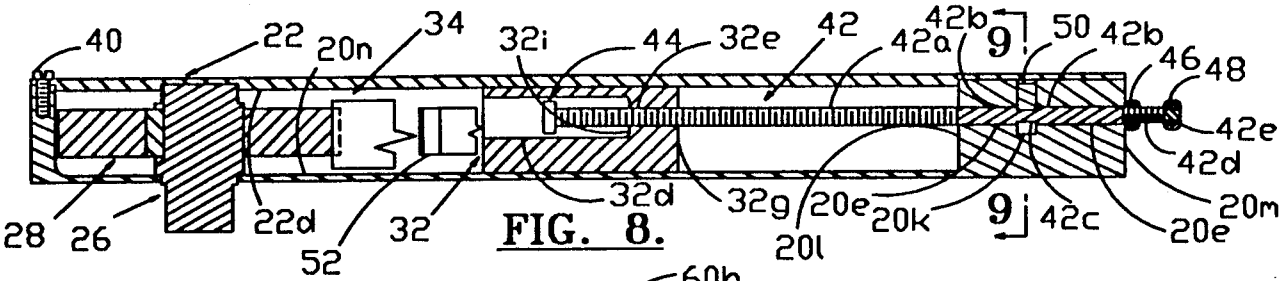
FIG. 8.
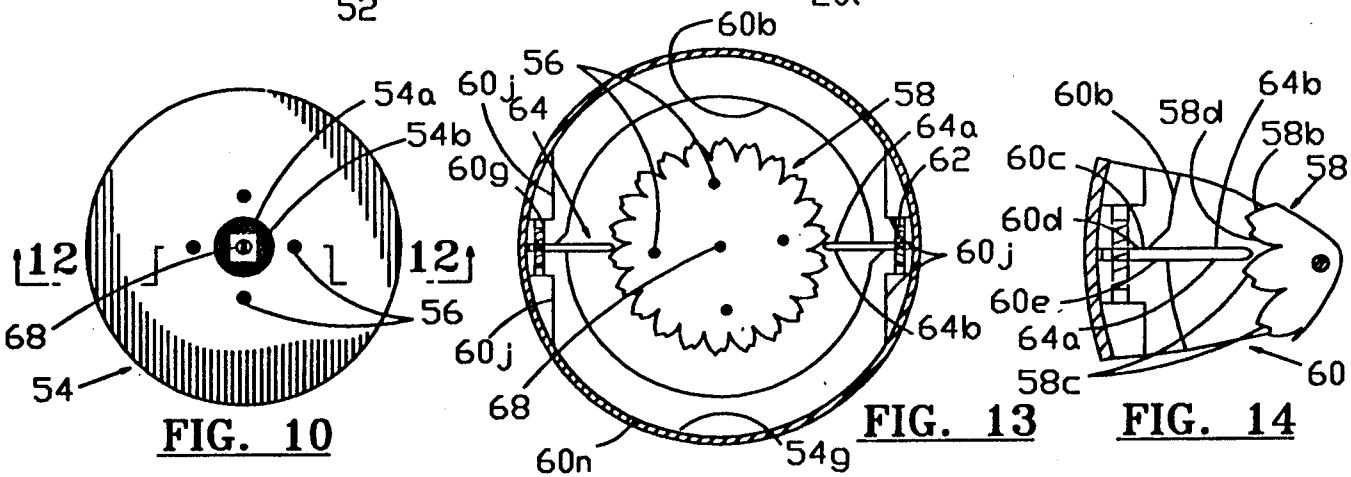
FIG. 10
FIG. 13
FIG. 14
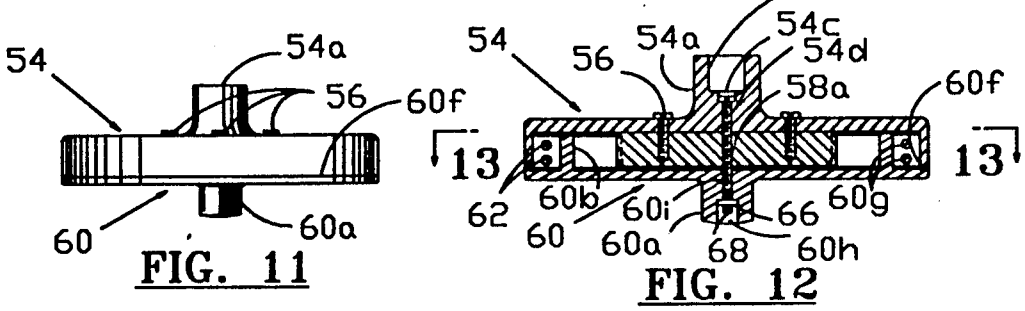
FIG. 12
FIG. 11

PREDETERMINED TORQUE YIELDING WRENCH

BACKGROUND—FIELD OF INVENTION

This invention relates to a torque yielding wrench used to apply a predetermined torque value to an object work element which may be a bolt, nut, fastener or the like and upon reaching this value will disengage without exceeding this setting.

The importance in industry of a precision wrench which will mechanically limit the amount of turning moment or torque is well known to persons familiar with the general requirements of mechanical fabrication, assembly, service, repair or inspection. Further, there is the requirement for a wrench that, without exceeding this preset value, will upon its attainment disengage the loading system of the wrench from a socket or other connecting member, and upon further rotation will only repeat the cycle of increasing from no-load to predetermined load, and will have the ability to produce this effect through a wide torque range for a series of varying sizes or of loading in subject work fasteners.

Heretofore, mechanical preset spring actuated torque applying wrenches have normally had their actuating springs continuously maintained in a loaded condition throughout their life. This period of existence in a constantly stressed form has had a tendency to shorten the life span by progressive failure and spring crystallization, and require frequent recalibration. Other problems have been their multiplicity of parts and the requirement of high precision in fabrication.

Various inventors have created numerous modifications and variations to achieve a torquing wrench capable of obtaining preset values. U.S. Pat. No. 3,137,187 to Van Hoose (1964) discloses a torque limiting wrench that has a torsion bar and sliding clamp to change the wrench's effective length but is highly complex. U.S. Pat. No. 3,279,286 to Larson (1966) is a preset torque measuring device that uses a split shank of a non-common hand wrench material that must be precisely reproduced, will operate over a limited range and has a working mechanism open to the intrusion of foreign materials such as grease, particles, etc., with the possible modification of the setting or complete failure of the wrench. U.S. Pat. No. 1,512,192 to Benko (1924) is a preset device that uses a lever arm, a pawl member with a sliding mounted spring that applies a varying load to a toothed wheel, and with the difficult ability to consistently reproduce an accurate value. U.S. Pat. Nos. 2,734,412 to Orner (1956), 3,003,378 to Hotchner (1961), 2,427,153 to Mossberg (1947), and 2,674,108 to Latimer (1954) have a similarity of intent but widely varying complex systems.

OBJECTS AND ADVANTAGES

An object of this invention is to provide a wrench of the type mentioned which is simple to fabricate and to operate.

Another object is to provide a wrench which is accurately calibrated to mechanically release the loading system when a predetermined torque is exceeded.

Still another object of this invention is to provide a wrench in which the load applying elements are not under elastic deformation until the wrench is actively used to apply a torque to the loaded element. The common operation of torque wrenches, heretofore available and known to the public, is one in which the actuating springs are continuously maintained under elastic deformation which is detrimental to wrench life and repetitive accuracy.

A further object is to provide a torque applying wrench, actuated by a cantilever member of elastic material, which operates over a widely diversified range of torquing values.

A still further object is to provide a wrench in which the torque setting is made when the wrench is under no internal spring load.

One other object is to provide a wrench in which the replacement of the cantilevered spring with another of different configuration will allow the wrench to operate under a different torque load range.

Still another object of this wrench is to provide a configuration in which the predetermined torque may be set by the application of an impact or hammer-like blow.

One other object of this wrench is to provide a configuration in which the induced preset torque load and the load applied in the releasing engagement may be different, without a change in wrench setting.

Another object is to provide a wrench in which the predetermined setting will be maintained for long service periods without the necessity of frequent recalibration of the wrench.

Another object is to provide a configuration of the wrench such that upon reaching the predetermined torque setting: three results occur; (1) There is significant wrench handle rotation, (2) there is an audible snapping sound made which can be heard in a noisily environment, and (3) there is a distinct change in handle resistance as the wrench goes from the load to the no-load condition.

Another object is to provide a torque limiting wrench in which, within and throughout the range of torquing values, the limiting applied turning moment may be infinitely varied or set.

Other objects and advantages will be apparent from the specification below.

DRAWING FIGURES

FIG. 4 is a side elevational view taken along section line 4—4 of FIG. 1.

FIG. 5 is a side elevational view taken along reference line 5—5 in FIG. 1 showing the relative position of the bridge with reference to the index mark.

FIG. 6 is a section elevational view taken along line 6—6 in FIG. 2 showing the relationship between the bridge and the left spring.

FIG. 7 is a top elevational view of the torque wrench showing a configuration in which the bridge is positioned with a drive screw and sound amplifiers are added to the bridge.

FIG. 8 is a sectional view in elevation taken along a step section line 8—8 in FIG. 7 showing the bridge and drive screw system.

FIG. 9 is a section elevational view taken along line 9—9 in FIG. 8 showing the drive screw retainer.

FIG. 10 is a plan elevational view of an alternate torque wrench configuration in which the torque is imparted by a conventional socket wrench or lever inserted in the squared drive recess.

FIG. 11 is a side elevational view of FIG. 10.

FIG. 12 is a side sectional view taken along a step section line 12—12 of FIG. 10.

FIG. 13 is a plan elevation view taken along line 13—13 of FIG. 12 and FIG. 17.

FIG. 14 is a top view of a section showing the left spring and a segment of the drive gear of FIG. 13.

REFERENCE NUMERALS IN DRAWINGS

Figure 1:
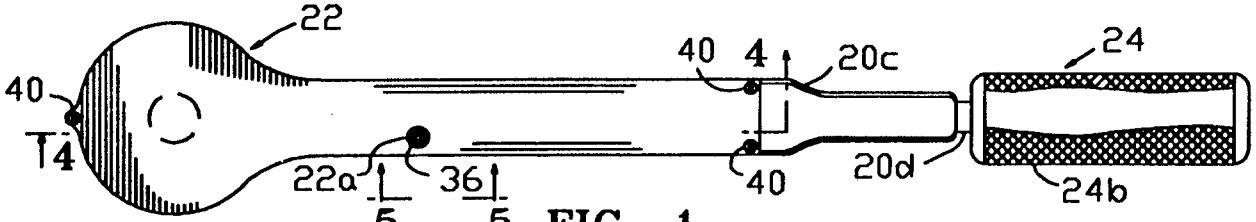
FIG. 1 is a top elevational view of the torque wrench.

In the drawings, closely related parts have the same reference number but different alphabetic suffixes.

| No. | Name | FIG. |
|---|---|---|
| 20 | body | 2,4 |
| 20a | cylindrical body section | 2,3,4 |
| 20b | channel body section | 2,3,4,5,6,9 |
| 20c | beam body section | 1,2,3 |
| 20d | threaded shank | 1,2,7 |
| 20e | divided drive screw bore | 8 |
| 20f | body window | 2,5,6 |
| 20g | index mark | 2,5 |
| 20h | counterbore | 2,3 |
| 20i | shaft bore | 4 |
| 20j | spring slot | 3,9 |
| 20k | screw positioner slot | 8 |
| 20l | body face | 3,8 |
| 20m | body lock face | 7,8 |
| 20n | lower body face | 4,6,8 |
| 20o | vertical body face | 3,6 |
| 20p | round cylindrical shape | 7 |
| 22 | cover plate | 1,2,4,6,7,8,9 |
| 22a | cover plate set screw boss | 1,2,5,6 |
| 22b | cover plate shaft housing recess | 4 |
| 22c | cover plate lip | 5,6,9 |
| 22d | cover plate bottom face | 4,6,8 |
| 24 | handle | 1,2,7 |
| 24a | handle bore | 2 |
| 24b | handle knurling | 1 |
| 26 | shaft | 3,4,8 |
| 26a | cylindrical shaft end | 3,4 |
| 26b | shaft key slot | 3,4 |
| 26c | shaft shoulder | 4 |
| 26d | polygonal stub | 2,4 |
| 26e | spherical ball detent | 2 |
| 28 | gear | 3,4,7,8 |
| 28a | gear key slot | 3 |
| 28b | gear tooth | 3 |
| 28c | gear tooth drive shoulder | 3 |
| 28d | gear bore | 3,4 |
| 30 | key | 3,4 |
| 32 | bridge | 3,4,6,7,8 |
| 32a | bridge spring slot | 6 |
| 32b | bridge drive hole | 5 |
| 32c | bridge calibration lines | 5 |
| 32d | bridge counterbore | 8 |
| 32e | bridge threaded section | 8 |
| 32f | bridge gear face | 3 |
| 32g | bridge handle face | 3,8 |
| 32h | bridge side walls | 6 |
| 32i | interior face | 8 |
| 34 | leaf spring | 3,4,6,7,8,9 |
| 34a | load face | 3 |
| 34b | handle end | 3 |
| 36 | set screw | 1,6 |
| 38 | cap screw | 2,3,4 |
| 40 | cover retaining screw | 1,2,3,4,7,8 |
| 42 | drive screw | 8,9 |
| 42a | threaded bridge drive section | 8 |
| 42b | unthreaded divided body section | 8 |

-continued

| No. | Name | FIG. |
|---|---|---|
| 42c | step-down or flute | 8 |
| 42d | threaded locknut section | 7,8 |
| 42e | drive knob step-down section | 8 |
| 44 | stop nut | 8 |
| 46 | lock nut | 7,8 |
| 48 | knurled drive knob | 7,8 |
| 50 | furcated screw retainer | 8,9 |
| 52 | sound amplifier | 7,8 |
| 54 | bowl shaped housing | 10,11,12,15,16,17 |
| 54a | cylindrical nose extension | 10,11,12 |
| 54b | squared drive recess | 10,12 |
| 54c | nose counterbore | 12 |
| 54d | housing bore | 12 |
| 54e | housing polygonal stub | 15,16,17 |
| 54f | square housing nut recess | 15,17 |
| 54g | housing inner vertical face | 13 |
| 56 | gear retainer screw | 10,11,12,13,15,16,17 |
| 58 | drive gear | 13,14 |
| 58a | drive gear bore | 12,17 |
| 58b | gear long tooth load face | 14 |
| 58c | gear long tooth impact face | 14 |
| 58d | gear short tooth load face | 14 |
| 60 | base | 11,12,14,16,17 |
| 60a | base polygonal stub | 11,12 |
| 60b | base crescent | 12,13,14,17 |
| 60c | base spring slot | 14 |
| 60d | base load shoulder | 14 |
| 60e | base impact shoulder | 14 |
| 60f | base lip | 11,12,16,17 |
| 60g | base pin bore | 12,13,17 |
| 60h | square base nut recess | 12 |
| 60i | base center bore | 12,17 |
| 60j | triangular pocket | 13 |
| 60k | base cylindrical nose extension | 16,17 |
| 60l | base squared drive recess | 17 |
| 60m | base nose counterbore | 17 |
| 60n | base outer vertical face | 13 |
| 62 | rollpin | 12,13,17 |
| 64 | spring | 13 |
| 64a | spring load face | 13,14 |
| 64b | spring impact face | 13,14 |
| 66 | nut | 12,17 |
| 68 | closure screw | 10,12,13,15,17 |

DESCRIPTION—FIGS. 1 TO 14

Figure 2:
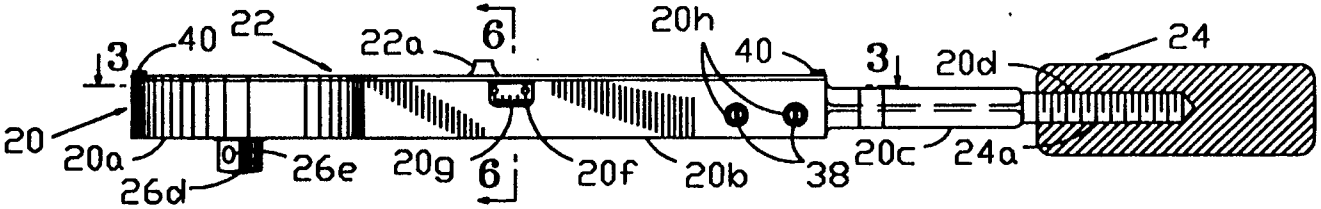
FIG. 2 is a side elevational view of FIG. 1.

A typical embodiment of this predetermined torque yielding wrench is illustrated in FIG. 1 (top view) and FIG. 2 (side view).

The wrench includes a handle 24, which may be knurled **24*b* for better gripping. The handle is formed with a bore 24*a*, which receives the threaded shank 20*d* of the body 20. The body 20 changes in configuration from the threaded shank 20*d* into the beam body section 20*c*, and then into the channel body section 20*b* which enlarges into the cylindrical body section 20*a*. The body sections 20*a* and 20*b* are capped with cover plate 22 which is held in place with cover retaining screws 40**.

Figure 3:
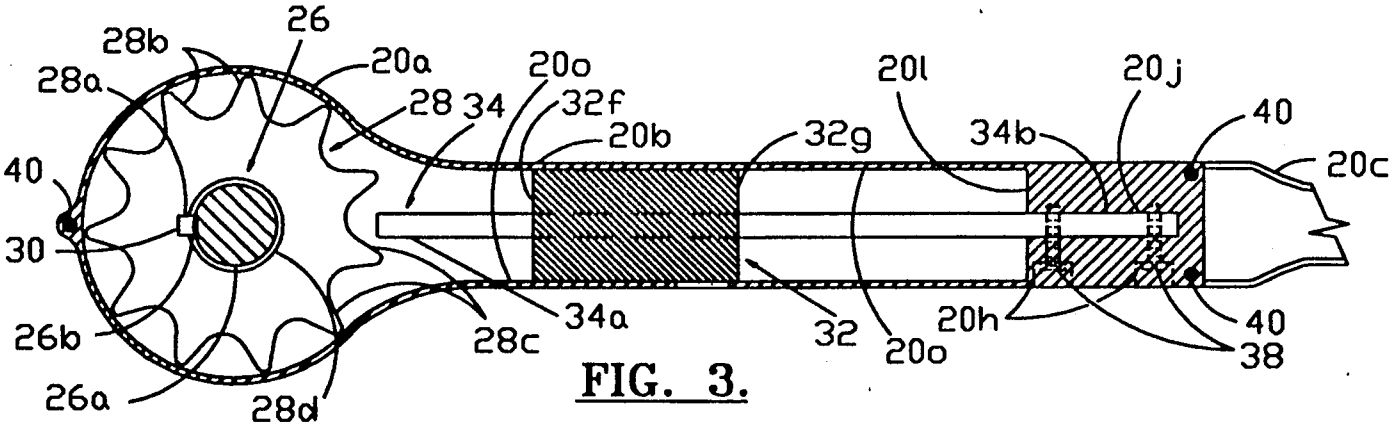
FIG. 3 is a plan elevational view taken along reference line 3—3 of FIG. 2.

FIG. 3 presents a longitudinal plan view of a hollow formed of body sections **20*a* and 20*b*, while FIG. 4 illustrates the relative positions of the shaft 26, the gear 28, the leaf spring 34 and the sliding bridge 32**.

FIG. 4 shows the shaft's upper cylindrical end **26*a* retained in the cover plate's shaft housing recess 22*b* while the lower shaft shoulder 26*c* is supported by the body 20 and located by the shaft bore 20*i***.

Variously sized sockets may be detachably fitted to the polygonal stub **26*d* which is an extension of the shaft 26. The shaft has a key slot 26*b* that is in alignment with a mating gear key slot 28*a* and transmission of forces between then is induced by the inherent shear of the key 30**.

The gear 28 is vertically positioned (FIG. 4) to operate between the bottom face 22*d* of the cover plate 22 and the lower body face 20*n* of the hollow cylindrical body section 20*a*. The turning force in the gear 28/shaft 26 system is induced by force applied to the gear tooth drive shoulder 28*c* by the load face 34*a* of the leaf spring 34 (assuming right hand tightening rotation of the fastener). The leaf spring 34 acts as a cantilevered beam of variable length. The length being controlled by the longitudinal position of the bridge 32. The bridge is slidingly located in a pocket formed between the vertical body faces 20*o* (FIG. 6), and its movement is obtained by inserting a pointed object in a bridge drive hole 32*b* (FIG. 5) and pushing laterally until the desired torque value may be read in the body window 20*f* by alignment of bridge calibration lines 32*c* with the body index mark 20*g*. This position is then fixed by rotation of the set screw 36, which is threaded in the cover plate set screw boss 22*a*, until locking engagement is made with the top face of the bridge.

The handle end 34*b* of the leaf spring 34 is installed in the spring slot 20*j* and fixed in position with the cap screws 38, which are threaded into the body 20 and located with the heads recessed in the counterbore 20*h*.

FIG. 7 and FIG. 8 illustrate an alternate configuration in which the bridge 32 is mechanically positioned with the drive screw 42. The drive screw is divided into five sections; the threaded bridge drive section 42*a*, the unthreaded divided body section 42*b*, the threaded locknut section 42*d*, the step-down or flute 42*c* and the drive knob step-down section 42*e*.

The threaded bridge drive section 42*a* is in threaded engagement with the bridge threaded section 32*e*. Bridge 32 movement toward the gear 28 is limited by engagement of the stop nut 44 with the inside face 32*i* of the bridged counterbore 32*d* while bridge movement toward the handle end of the drive screw is limited by the bridge handle face 32*g* meeting the body face 20*l*.

The unthreaded divided body section 42*b* (FIG. 8) is located in the divided drive screw bore 20*e* in the handle end of the body 20 and by its rotation drives the bridge 32 fore and aft as the thrust imparted in this rotation is contained in the shaft positioned slot 20*k* by the interrelationship of the furcated screw retainer 50 and the screw shafts flute 42*c* (FIG. 9). Turning of the drive screw 42 is developed by rotation of the knurled drive knob 48 which is slidingly positioned on the drive knob stepdown section 42*e* of the drive screw where it may be fixed in position by staking or other means. Upon obtaining a reading of the desired torque value in the body window 20*f* the bridge is restrained in a fixed position by turning the locknut 46 until frictional engagement is made with the body lock face 20*m*.

In this torque wrench configuration the body section between the channel body section 20*b* and the handle 24 has been changed into a round cylindrical shape 20*p* (FIG. 7) to allow room for finger engagement of the knurled drive knob 48 or the lock nut 46. However; either body concept, the beam body, the round cylindrical shape or others, could be used between the channel body section 20*b* and the handle 24.

It may be desirable in certain cases to make provision for a distinct snapping sound to occur as the leaf spring 34 reaches its preset value. This may be obtained by the addition of a sound amplifier 52 to the bridge 32 (FIG. 7) on either side of the leaf spring 34, which will allow for torquing by either clockwise or counterclockwise rotation. The leaf spring movement in loading will separate the two parallel items, the sound amplifier 52 and the leaf spring 34, and upon release after reaching the preset torque value the leaf spring will snap back to its unloaded position with the sudden engagement of the sound amplifier and resultant audible noise.

FIG. 1 through FIG. 9 show concepts different only in refinements. The basic wrench as illustrated in FIGS. 1 through 6 is modified in FIGS. 7, 8 and 9 to show variations in detail, specifically a screw actuated mechanical bridge drive system and the addition of sound amplifiers. In all instances the gear 28 shown is the preferred embodiment of the basic wrench with the gear teeth spaced such that upon reaching the calibrated value the release of the leaf spring from the gear tooth will return to a neutral position in which the spring comes to rest in a space between teeth.

However; by increasing the number of teeth in the gear 28 and without any other change, the leaf spring could be allowed to strike a following gear tooth and thus impart an abrupt impact load which necessitate a complete wrench recalibration with reference to bridge position.

In FIGS. 13 and 14 the drive gear 58 has teeth in what may be defined as double toothed shape as the configuration and tooth spacing is such that the initial release of the spring, when functioning to unload the fastener, allows it elastic return toward the neutral position to be impeded by the addition of a secondary tooth which in effect imparts an impact load to the fastener.

Figure 17:
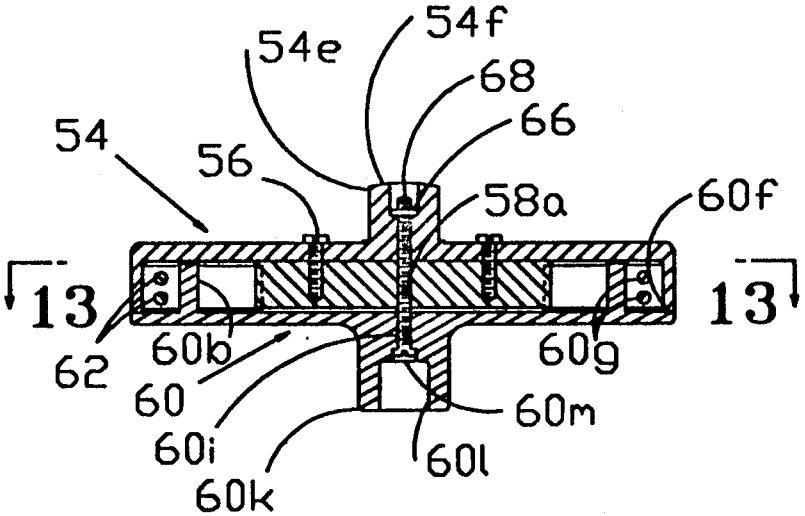
FIG. 17 is a side sectional view taken along a step section line 17—17 of FIG. 15.
Figure 15:
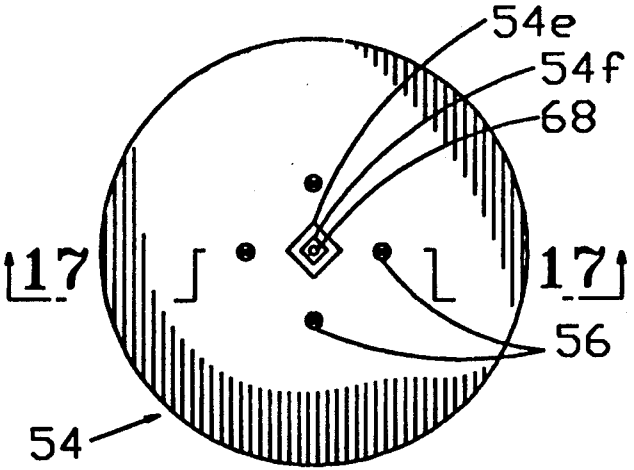
FIG. 15 is a plan elevational view of an alternate torque wrench configuration in which the torque is imparted by a conventional socket wrench or lever inserted in the base squared drive recess.
Figure 16:
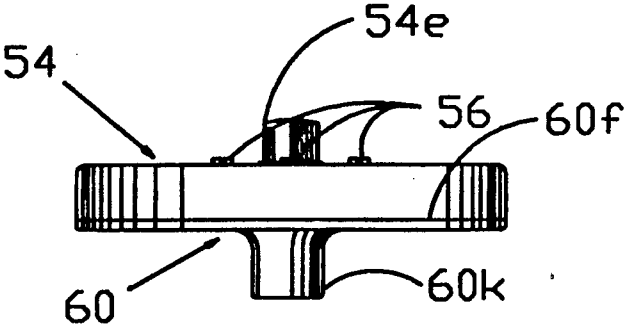
FIG. 16 is a side elevational view of FIG. 15.

Further; FIGS. 10 through 17 show a device in which the handle has been omitted and the torquing-/impacting forces are contained within a head and turning motion is induced by a conventional wrench, Allen wrench or other arm, that is inserted in the squared drive recess 54*b* (FIG. 12) or the base squared drive recess 60*l* (FIG. 17). Item 54 is a bowl shaped housing that supports a drive gear 58 that is held in position by a number of gear retainer screws 56. In the configurations shown four are used.

Nested with the housing 54 is the mechanism. The base 60 has a circumferential lip 60*f* that forms a resting surface for the housing. Within this circle is a base crescent 60*b* that has two circumferential vertical parallel faces. The base outer vertical face 60*n* forms a sliding mating face for the housing inner vertical face 54*g* which rotates around the base.

FIG. 13 is a plan view showing the relative positions of the gear 58 and, in the configuration illustrated, two springs 64. However, the number of springs could vary from one to a large odd or even multiple number of springs 64. In this concept the springs are diametrically opposed and the construction of the gear 58 is such that equivalent actions are simultaneously applied on each side of the base 60. The springs 64 are slipped into base spring slots 60*c* and each fixed in position with two rollpins 62. A triangular pocket 60*j* is cut on either side of each spring to give access for the installation or removal of the rollpins 62.

The spring slot 60*c* has two vertical faces (FIG. 14); one 60*d* is the short base load shoulder and the other 60*e* is the long base impact shoulder. The load shoulder is tapered or inclined so that as relative motion of the gear is in a clockwise direction (FIG. 13) the spring acts as a long cantilever beam while rotation in a counterclockwise direction would load the spring 64 against the square shoulder 60*e* with a consequently shorter effective spring length and thusly a stiffer beam. Therefore; turning in one direction tends to load a fastener while reverse turning will unload or loosen with a larger force. Further; while a gear similar in shape to gear 28 could be used, in the illustrations of FIGS. 13 and 14 a drive gear 58 with a single shape load face and with a double toothed shape impact face has been utilized and as the spring will first engage the short tooth 58*d* when turning in a loosening direction then after a slipping engagement separation will occur and the spring will strike the longer tooth 58*c* with an impact load which would be very effective in breaking free a fastener that might be temporarily frozen in place.

The action between the crescent 60*b*, spring 64 and gear 58 is such that the crescent load face 60*d* is on the opposite side of the springs load face 64*a* and this face in turn will engage the load face of the gears' long tooth 58*b*, while opposite relative movement causes the impact face 60*e* of the crescent to force the far side of the spring to be the impact spring face 64*b* with consequent engagement of the short gear tooth 58*d*.

In the configuration shown in FIGS. 10, 11, and 12 the cylindrical nose extension 54*a* with its internal square drive recess 54*b* is formed as an integral part of the gear half of the system. While; the base polygonal stub 60*a*, which drives a working socket is an integral part of the base. However; in FIGS. 15, 16, and 17 which may be a more preferred configuration, as it is believed that the load and impact is best imparted to the fastener by the gear system, the subject fastener is driven by the housing polygonal stub 54*e* and the torque is induced by rotation developed in the base squared drive recess 60*l* by an Allen wrench or other arm.

FIG. 12 illustrates the method by which the bowl shaped housing 54 is mated and retained in fixed position with the base 60. A long closure screw 68 is inserted on a center line through the nose counterbore 54*c* and the drive gear bore 58*a*. It is tightened into an operating position by rotation of its head in the nose counterbore 54*c* and locking engagement by nut 66 positioned in the square base nut recess 60*h*. While in FIG. 17 as the bowl shaped housing 54 is similarly mated with the base 60 the closure screw 68 is inserted on a center line through the base nose counterbore 60*m*, the base center bore 60*i*, and the drive gear bore 58*a*. It is tightened into an operating position by rotation of its head in the base nose counterbore 60*m* and locking engagement by nut 66 positioned in the square housing nut recess 54*f*.

OPERATION FIG. 1 TO FIG. 15

The method of using the wrench in its simplest form, as illustrated in FIGS. 1 through 6, is to position the bridge 32 to a setting for a predetermined value. This is made by moving the bridge 32 left or right until the calibrated torquing number can be read in the body window 20*f* by alignment of the bridge calibration lines 32*c* with the index mark 20*g*. The bridge is then restrained in position by the set screw 36.

A torque transferring element such as a conventional socket is inserted over the polygonal stub 26*d* which may contain a conventional socket retainer such as the standard spring impelled spherical ball detent 26*e*.

The socket is located over an object fastener and the handle 24 is turned in clockwise or counterclockwise direction, whichever is appropriate as torquing may be made for either a right or left hand thread system.

The frictional resistance between the object fastener and its interfacing surface is overcome until the desired value is reached at which time the mechanical connection will stop applying load.

The load path starts in the wrenches channel body section 20*b* at the bridge gear face 32*f* which determines the fixed end of the leaf spring 34 acting as a cantilever beam. The beam stiffness being a function of its length with the highest load value generated by the shortest length of possible flexure.

As body 20 rotation begins the spring load face 34*a*, assuming a right hand thread system, will make engagement with the gear tooth's drive shoulder 28*c*, with the initial position of the end most point of the leaf spring 34 being a point in the root opening between teeth. This will give the shortest lever arm between the center line of the shaft 26 and the initial spring/gear tooth engagement point, and at the same time will impart the lowest force from the spring 34 as it will have the longest arm with the smallest deflection and thus the highest load.

Further turning will increase beam spring deflection with consequent increases in the load applied to the gear tooth 28*c*, and at a progressively further distance from the shaft center line. This combination of a larger force and a longer arm will inducer a progressively larger turning moment to the subject fastener that will only terminate upon obtaining the predetermined value with subsequent disengagement or declutching of the spring 34/gear 28 interface.

The maximum moment for the specific bridge position may actually occur shortly before separation is made but the specific value will be ascertained by wrench calibration which will be repeatedly consistent within manufacturing tolerances.

The gear 28 is formed with teeth spacing such that as the leaf spring 34 springs back into a neutral position no engagement will be made with a second tooth and thus no impact load imparted to the object fastener.

When the wrench system is not actively inducing a fastener load, the leaf spring 34 is at rest without distortion in a neutral position between teeth 28*b*. Spring-actuated torque applying wrenches heretofore commonly available to the public have their actuating springs under elastic distortion throughout their life. Thus, this extended period of spring strain causes a change in crystallization structure with a consequent variation in spring performance and a necessity of frequent recalibration and further, it creates the inability to accurately predict the actual release value or to make a fine tolerance adjustment.

A modified embodiment of the basic wrench is illustrated in FIG. 7 and FIG. 8 in which sound amplifiers 52 and a drive screw 42 system have been added. In the FIG. 1 through 6 concept, bridge movement is obtained by inserting a pointed object into a bridge drive hole 32*b* and exerting a thrust until the desired position is secured. Further, while sound amplifiers and a drive screw have been added, a deletion also exists as the cover plate set screw boss 22*a* and the set screw 36 have been omitted.

The bridge 32 is now shifted into the predetermined calibrated setting by rotation of the drive screw 42, which is divided into five parts; each performing a distinct but interrelated function. First; the threaded bridge drive section 42*a* which moves the bridge toward and away from the gear 28 with travel being limited by the stop nut 44 which will terminate movement toward the gear 28 as the stop nut 44 makes engagement with the interior face 32*i* and bridge movement away from the gear will stop as the bridge handle face 32*g* abuts the body face 201. This range of movement will define the torquing range of the wrench with the minimum torque starting as the bridge is in its most remote position from the gear and its maximum with the closest proximity of the bridge to the gear. This being the simple function of the longest bendable leaf spring length giving the slightest gear tooth loading.

The length of the bridge threaded section 32*e* is principally a function of the desired bridge travel with relationship to the specific wrench geometry for the desired torque range and not a function of required thrust as bridge movement is made with the spring mechanism under no load and the only force necessary to overcome being that of starting and moving friction between the bridge and its containing envelope consisting of the lower body face 20*n*, the two vertical body faces 20*o* and the cover plate bottom face 22*d*.

The second drive screw 42 section is the unthreaded divided body section 42*b* which provides support and acts as a guide.

The third is the step-down or flute 42*c*, which is centered in the shaft positioner slot 20*k* and maintained in position by the furcated screw retainer 50 (which is inserted into sliding engagement as illustrated in FIG. 8 and cross-section FIG. 9). The interaction between these three 42*c*, 20*k* and 50 provide the resisting thrust which will allow drive screw 42 rotation to induce lateral bridge 32 motion.

The fourth drive screw 42 section is the threaded lock nut section 42*d* and the fifth is the drive knob step-down 42*e* on which the knurled drive knob 48 is slipped and staked into position.

Rotation of the drive knob 48 is made after rotation of the lock nut 46 is made such that the lock nut is backed away from the body lockface 20*m*. The drive screw is then free to rotate and thus to generate bridge movement until the desired value is ascertained upon which the lock nut will rotate forward until frictional engagement is made between the face of the locknut 46 and the body lock face 20*m*. In this instance as in others throughout this document most frequently the simplest systems are defined and as desired they may be refined with complexity to achieve a specific result. For example, to further insure against drive screw rotation the lock-face 20*m* and the locknut 46 might be separated by a lock washer of metal, fiber or plastic.

In FIG. 7 the cut-out section in the cover plate 22 shows the sound amplifiers 52 in position on either side of the leaf spring 34. Each sound amplifier is a bent leaf spring which slides into a vertical slot in the bridge 32. As the leaf spring goes into load there is a consequent leaf spring deflection and thus separation is made between the sound amplifier 52 and the convex side of the leaf spring 34 and as the torquing value is reached release of the leaf spring 34 from the gear 28 would facilitate rapid spring return to a neutral position with a sudden re-engagement between the leaf spring 34 and the sound amplifier 52 and a consequent distinct audible metallic report.

The addition of sound amplifiers might change the torquing value as calibrated without their presence. This would be a function dependent upon their size, shape and position as well as that of the complete wrench system. However, if sound amplifiers are used the wrench would be calibrated with them both in and out of position and if different values were obtained for an identical bridge position then a second set of bridge calibration lines would be added.

An alternate configuration is shown in FIGS. 10 through 17. In this construction the gear 58 has a complex gear tooth form such that it has a double toothed form on one side and single toothed form on the other. The long tooth 58*b* will, upon a relative clockwise rotation of the gear 58 with reference to the spring 64, make engagement with the spring and load the fastener while relative counterclockwise gear 58 rotation will produce load when the short tooth 58*d* and the spring 64 meet and upon further rotation produce an impact load as the spring and secondary or long face 58*c* make sudden and rapid engagement. Thus, while the wrench is configured to torque an item to a predetermined value with rotation in one direction its alternate function is to loosen the subject fastener when rotating in the opposite direction by imparting impact blows which will act to break free the thread engagement of those fasteners which tend to set up due to time, corrosion, oxidation, or whatever.

This apparently contradictory concept of torquing to a load value in one direction and to unload by overtorquing in the obverse without making a change in spring setting occurs due to two factors; one, the tooth shape and second, the spring retaining shoulders in which the spring is held in a slot 60*c* with a base load shoulder 60*d* and a base impact shoulder 60*e*.

In FIG. 14 turning motion is induced by a conventional wrench, Allen wrench, or other arm, that is inserted in the squared drive recess 54*b* (FIG. 10) or the base squared drive recess 60*l* (FIG. 17) and relative clockwise rotation of the drive gear 58 allows the spring load face 64*a* to engage the gear long tooth load face 58*b*. This relative movement loads and deflects the spring 64 against the short base load shoulder 60*d* which creates a relatively long cantilever beam. As rotation proceeds the spring continues to load and deflect until maximum value and then release at which time the combination of continuing rotation and spring flex back will allow the spring end to clear the short load tooth 58*d* without contact when the subject fastener is in the loading mode.

Relative counterclockwise rotation of the gear 58 or clockwise rotation of the base 60 will induce loosening of the previously tightened fastener. Engagement will begin with the spring impact face 64*b* meeting the gears short tooth impact face 58*d* with a consequent spring deflection about the base impact shoulder 60*e*. This relative motion will effectively bend a stiffer beam due to its effectively shortened length thus as rotation is continued and the springs tip slips past the end of the short tooth 58*d* it will suddenly engage the protruding gear long tooth impact face 58*c* with an abrupt, distinct and sudden blow. Further, continuous rotation would impart a series of hammer-like loosening strikes.

SUMMARY, RAMIFICATIONS, AND SCOPE

Accordingly, the reader will see that the predetermined torque yielding wrench of this invention provides a highly reliable, simple to fabricate device that can be constructed of a small number of parts that is easy to set and will operate over a wide range of values.

It permits the production of a wrench in which the load applying elements are not under stress until the wrench is activated in a direct torquing action.

It permits the substitution of a different cantilevered spring and bridge with a resultant change in the torque load range.

It provides a basic construction in which a change in gear configuration will allow the achievement of the preset torque value by the application of an impact load.

It permits the fabrication of a wrench which due to its simplified construction and tendency to induce spring load only in torquing will permit wrench use for extended periods of time without recalibration.

It permits production of a wrench that may have the torquing value set to an infinite number of torques within the wrench's range.

Although the description above contains many specificities, these should not be construed as limiting the scope of the invention but as merely providing illustrations of some of the presently preferred embodiments of this invention. For example, the cover plate set screw boss could be positioned on the body and the function of retention of the bridge would be equally effective; the body window could equally effectively be located in the cover with the bridge calibration lines on the top bridge face instead of the side; the bridge's longitudinal movement could be activated by a rack and pinion system in which the rack could be cut on the bridge's top face and a thumb driving pinion gear supported in the cover; in the configuration with the handle the gear could be of the double toothed style on one face and single toothed on the other and the bridge could have a long shoulder on one side and a short shoulder on the other; in the torque head configuration the spring could be held within the constraint of a sliding or multiple fixed position bridge so that the load could be varied; in all configurations all parts, items, or whatever can be interchanged to produce a multiplicity of results.

I claim:

1. A wrench for transmitting a predetermined torque to an element comprising; a body having a housing at one end and a handle at an opposite end, a gear having spaced teeth rotatably secured in the housing, a drive stub keyed to the gear and extending out of the housing, said drive stub having a means to transmit torque to said element, a leaf spring having two ends, one of which is secured to the body between the handle and the housing, the other end of said leaf spring extending into engagement with the teeth of said gear, said leaf spring acting on a face of each said gear tooth to apply a driving force thereto to cause rotation of said gear and said drive stub upon angular movement of said handle, a torque adjusting means slidably mounted within said body between the handle and the housing for adjusting the amount of torque applied by said leaf spring to said gear, and a means for securing said torque adjusting means is a position within said body at a desired torque setting.

2. A wrench as described in claim 1 wherein each gear tooth is spaced such that release of said leaf spring from one tooth will impact the sequentially occurring next tooth.

3. A wrench as described in claim 1 wherein said torque adjusting means is a bridge with a longitudinal slot extending therethrough to receive said leaf spring.

4. A wrench as described in claim 3 wherein at least one sound amplifier is secured to said bridge.

5. A wrench as described in claim 1 wherein said body has an opening along a side thereof and said torque adjusting means has calibrated torque markings along a side such that said markings are visible through said opening, said body also including an index mark adjacent said opening whereby alignment of one of said markings with said index mark indicates a numeric torque value.

6. A wrench as described in claim 5 wherein said torque adjusting means is a bridge with a longitudinal slot extending therethrough to receive said leaf spring.

7. A wrench as described in claim 6 wherein said bridge is provided with apertures adjacent said markings adapted to receive a pointed object to cause sliding movement of said bridge.

8. A wrench as described in claim 1 wherein said means for securing said torque adjusting means is a set screw secured to said body that will engage said torque adjusting means.

9. A wrench as described in claim 6 wherein a threaded member is rotatably secured to said body intermediate said handle and said housing, said threaded member having an end threadably engaging said bridge such that rotation of said threaded member causes sliding movement of said bridge within said body whereby the torque applied to said element is adjustable.

10. A wrench as described in claim 9 wherein at least one sound amplifier is secured to said bridge.

11. A wrench for transmitting a predetermined torque to an element comprising; a housing having an upper portion and a lower portion, said upper portion being rotatable relative to said lower portion, a drive receiving member secured to one of said upper or lower portions, a drive transmitting member secured to the other of said upper or lower portions, a complex gear having complex gear teeth circumferentially spaced about said gear, said gear fixed to one of said upper or lower portions, a leaf spring secured at one end to the other of said upper or lower portions engaging said gear at the other end, said complex gear teeth each comprising a short tooth and a long tooth such that said leaf spring engages said long tooth when applying a tightening torque to said element, said leaf spring engaging said short tooth when applying loosening torque to said element whereby said leaf spring will slip over said short tooth, when said element is frozen, and impact on said long tooth to break said element free.

12. A wrench as described in claim 4 wherein said one end of said leaf spring is retained within a slot which defines two shoulders, on opposite sides of said leaf spring, in said other of said upper or lower portions, one of said shoulders being shorter than the other when said leaf spring is flexing in a direction suitable for tightening said element.

13. A wrench as described in claim 12 wherein said drive receiving member is secured to said upper portion and said drive transmitting member is secured to said lower portion.

14. A wrench as described in claim 12 wherein said drive receiving member is secured to said lower portion and said drive transmitting member is secured to said upper portion.

* * * * *